US010206516B2

(12) United States Patent
Savino

(10) Patent No.: US 10,206,516 B2
(45) Date of Patent: Feb. 19, 2019

(54) MATTRESS PROTECTOR

(71) Applicant: Momentum Marketing Group, LLC, Greensboro, NC (US)

(72) Inventor: Robert Adam Savino, Summerfield, NC (US)

(73) Assignee: MOMENTUM MARKETING GROUP, LLC, Greensboro, NC (US)

( * ) Notice: Subject to any disclaimer, the term of this patent is extended or adjusted under 35 U.S.C. 154(b) by 0 days.

(21) Appl. No.: 15/486,357

(22) Filed: Apr. 13, 2017

(65) Prior Publication Data

US 2018/0296003 A1 Oct. 18, 2018

(51) Int. Cl.
*A47C 27/00* (2006.01)
*A47C 31/10* (2006.01)

(52) U.S. Cl.
CPC ..... *A47C 27/008* (2013.01); *A47C 27/005* (2013.01); *A47C 31/105* (2013.01)

(58) Field of Classification Search
CPC ..... A47C 21/06; A47C 27/002; A47C 31/105; A47C 27/005; A47C 27/008; A47G 9/0246
See application file for complete search history.

(56) References Cited

U.S. PATENT DOCUMENTS 2,214,074 A 9/1940 Clarke
2,516,363 A 7/1950 Block et al.
3,591,875 A * 7/1971 Zipf, III ..... A47C 27/005 5/484
3,765,040 A * 10/1973 Holstein ..... A47G 9/0246 5/487
4,422,195 A * 12/1983 Russo ..... A47G 9/0246 5/495
4,454,615 A * 6/1984 Whitney ..... A47C 21/022 5/498
4,483,030 A * 11/1984 Flick ..... A61G 7/05769 156/274.6
4,922,565 A 5/1990 Blake
2002/0148047 A1 10/2002 Corzani et al.
2003/0121101 A1* 7/2003 Corzani ..... A47C 27/006 5/487
2005/0120486 A1* 6/2005 Buchanan ..... A47C 21/026 5/706
2006/0135014 A1* 6/2006 Murphy ..... A47C 31/001 442/304
2008/0005845 A1 1/2008 Moran Pfleger
2015/0096121 A1 4/2015 Scarleski

* cited by examiner

*Primary Examiner* — Eric J Kurilla

(74) *Attorney, Agent, or Firm* — Jenkins, Wilson, Taylor & Hunt P.A.

(57) ABSTRACT

A mattress protector includes a unitary flat sheet for covering a surface of a mattress and providing a liquiphobic barrier for the surface. The flat sheet has four corners with cuts in the sheet proximal to and following a contour of each corner (or alternatively following the contour of each corner and laterally from corner to corner) to form corner attachment members for extending from the surface and under the mattress, thereby securing the sheet to the mattress.

10 Claims, 8 Drawing Sheets

MATTRESS PROTECTOR

TECHNICAL FIELD

The subject matter described herein relates to mattress protectors. More particularly, the subject matter described herein relates to a mattress protector that is cost effective to manufacture and easy to change.

BACKGROUND

In today's markets, mattresses cost hundreds or even thousands of dollars and represent substantial investments for individuals and for the hospitality and healthcare industries. In the hospitality and healthcare industries, the cost of mattresses is magnified by the number of mattresses that can be present in a typical facility, such as a hotel or in-patient care facility. In light of the substantial investment made in mattresses, mattress protectors are used to prevent damage to mattresses. However, conventional mattress protectors are expensive to manufacture and/or difficult to change. For example, some existing mattress protectors require straps, Velcro® fasteners, or adhesive fasteners to be sewn into a protector sheet to hold the sheet securely to the mattress. Such features increase the cost of mattress protectors and make them difficult to manufacture.

Accordingly, in light of these difficulties, there exists a need for an improved mattress protector that is cost effective to manufacture and easy to change.

SUMMARY

According to one aspect of the subject matter described herein, a mattress protector includes a unitary flat sheet for covering a surface of a mattress and providing a liquiphobic barrier for the surface. The flat sheet has four corners with cuts in the sheet proximal to and following a contour of each corner to form corner attachment members for extending from the surface and under the mattress, thereby securing the sheet to the mattress.

The term "liquiphobic", as used herein, refers to generally repellant of liquids, including, but not limited to water, body fluids, beverages, etc.

BRIEF DESCRIPTION OF THE DRAWINGS

The subject matter described herein will now be explained with reference to the accompanying drawings of which.

DETAILED DESCRIPTION

Figure 1:
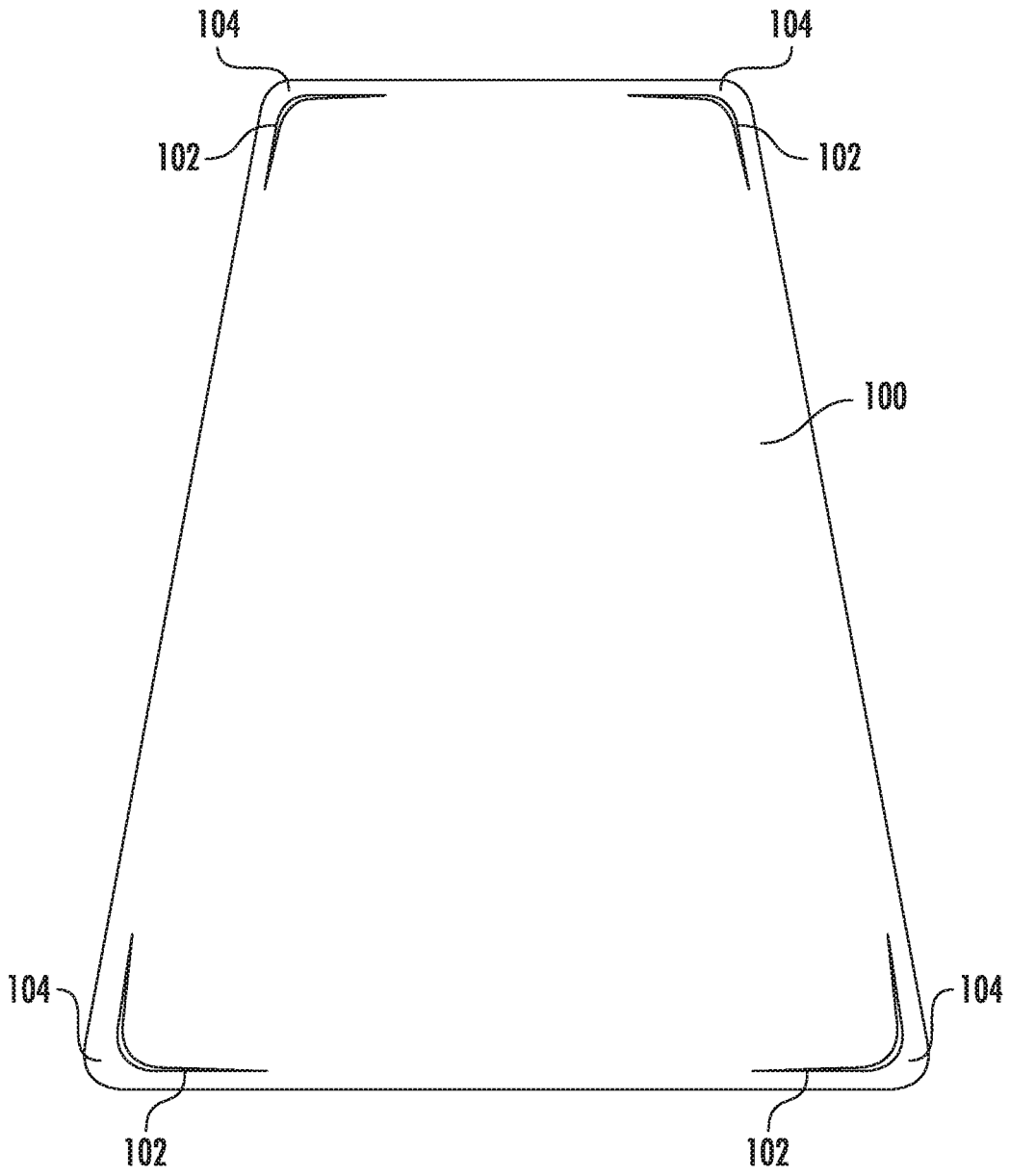
FIG. 1 is a top view of a mattress protector according to an aspect of the subject matter described herein.

As indicated above, it is desirable to have a mattress protector that is easy to manufacture and change. FIG. 1 is a top view of a mattress protector according to an aspect of the subject matter described herein. Referring to FIG. 1, the mattress protector comprises a unitary flat sheet 100 for covering a surface of a mattress. Unitary flat sheet 100 may be formed of any material that is itself liquiphobic or that can be chemically treated to be liquiphobic. In one example, sheet 100 is made of a spun-bound material and is treated to be liquiphobic. In the illustrated example, sheet 100 includes four corners with cuts 102 proximal to each corner and following a contour of each corner to form corner attachment members 104 for extending from the protected surface of a mattress under the mattress to secure sheet 100 to the mattress. Because corner attachment members 104 are part of sheet 100, the mattress protector illustrated in FIG. 1 is easy to manufacture as compared to mattress protectors that require straps, elastic, Velcro®, or other material to be sewn into the mattress protector.

Figure 2:
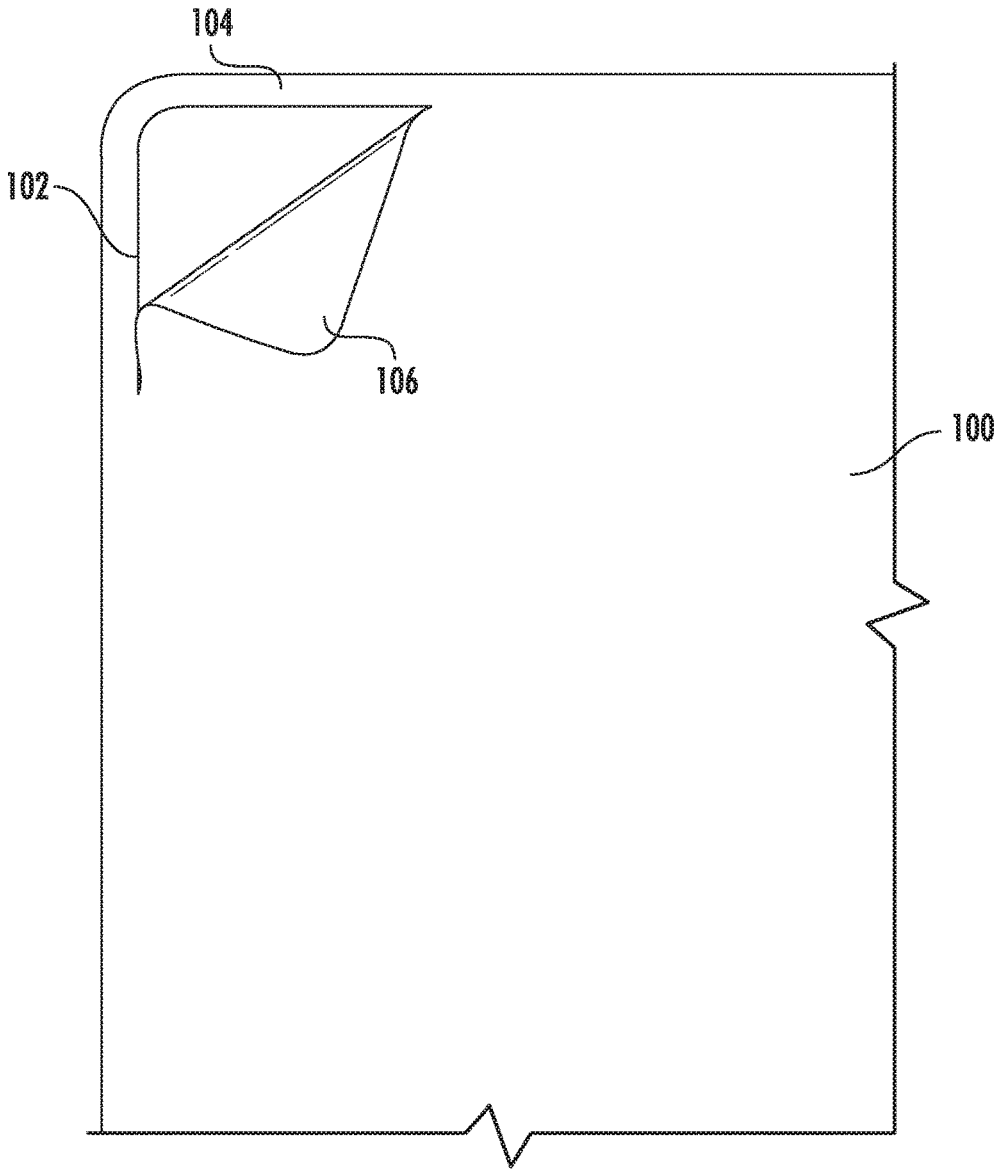
FIG. 2 is a top close up view of one corner of a mattress protector according to an aspect of the subject matter described herein.

FIG. 2 is a close up view of one corner of sheet 100 illustrating cut 102 and corner attachment member 104. As illustrated in FIG. 2, cut 102 extending around the contour of the corner forms a flap 106 that can rest on the protected surface of the mattress while corner attachment member 104 extends under the corner of the mattress.

Figure 3:
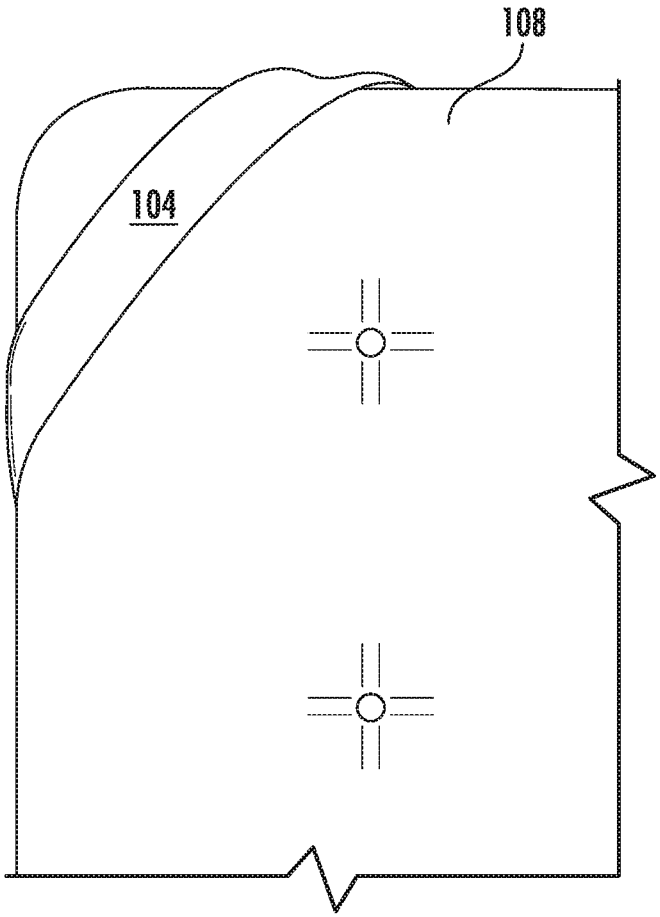
FIG. 3 is a bottom close up view of one corner of a mattress protector showing a corner attachment member securing the mattress protector to a mattress according to an aspect of the subject matter described herein.

FIG. 3 is a bottom view of a mattress protector showing attachment to a mattress. In FIG. 3, corner attachment member 104 extends under a corner of mattress 108. As a result, sheet 100 is securely attached to mattress 108 that can also be easily changed, simply by sliding each corner attachment member 104 out from under each corner.

Figure 4:
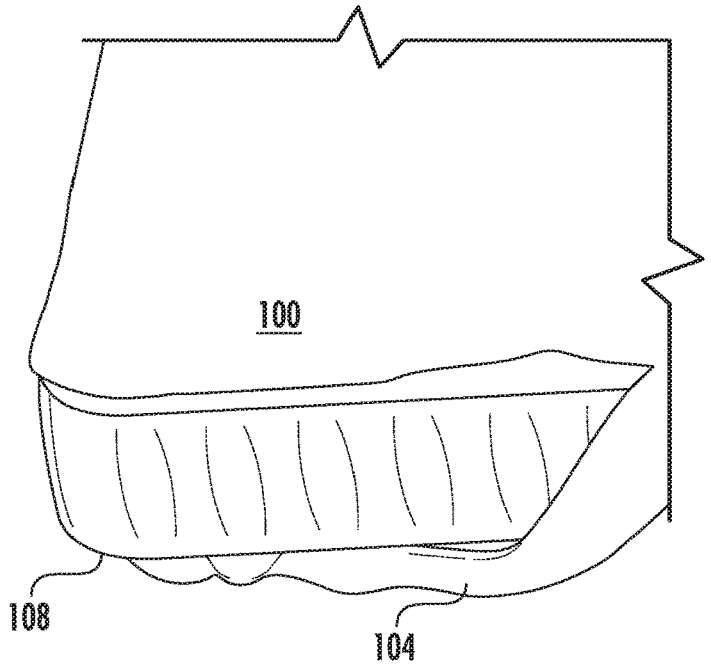
FIG. 4 is a side view of a mattress protector secured to a corner of a mattress according to an aspect of the subject matter described herein.

FIG. 4 is a close up side view illustrating the attachment of sheet 100 to a corner of mattress 108. In FIG. 4, it can be seen that corner attachment member 104 extends under mattress 108 and then diagonally upwards along the side of mattress 108.

Figure 5:
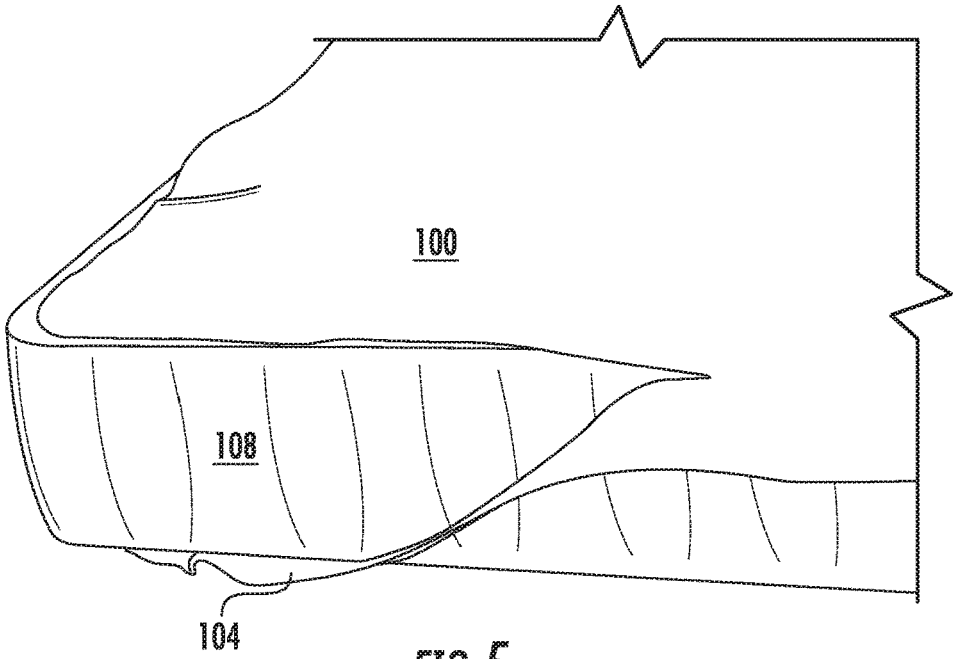
FIG. 5 is a top end view illustrating a mattress protector secured to one corner of a mattress according to an aspect of the subject matter described herein.

FIG. 5 is a close up end view illustrating the attachment of sheet 100 to a corner of mattress 108. In FIG. 5, corner attachment member 104 extends under mattress 108 and then diagonally up along the end of mattress 108.

Figure 6:
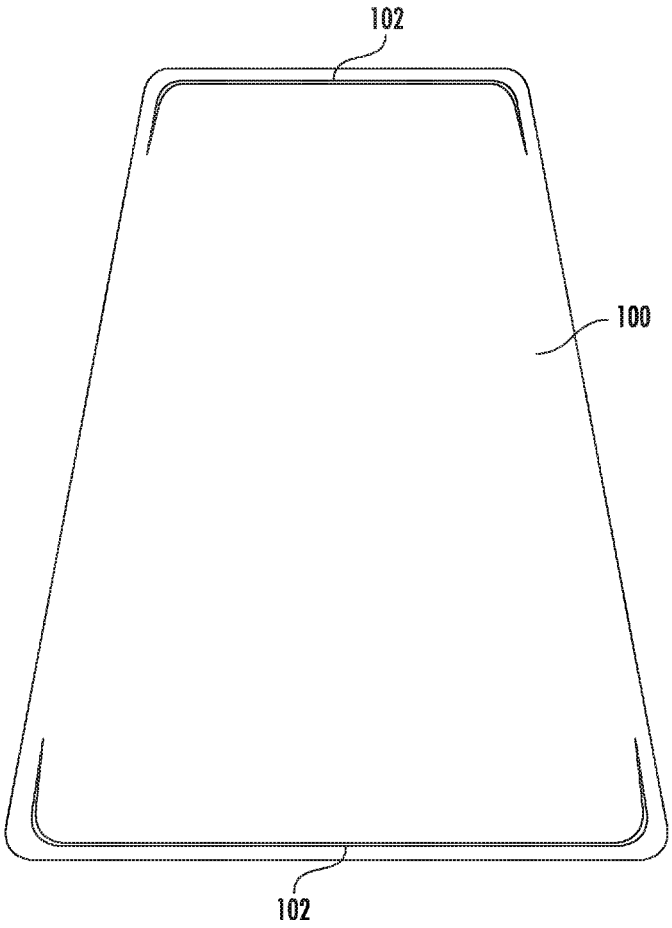
FIG. 6 is a top view illustrating an alternate implementation of a mattress protector according to an aspect of the subject matter described herein.

In the examples illustrated in FIGS. 1-5, cuts 102 do not extend laterally from corner to corner of sheet 100. In an alternate implementation as illustrated in FIG. 6, cuts 102 extend laterally from corner to corner of sheet 100 such that the cut in one corner is joined with the cut in an adjacent corner on each end of sheet 100. In FIG. 6, cuts 102 follow the contours of each corner of sheet 100 and also the contour of each end of sheet 100. Because cuts 102 extend laterally such that the cuts in adjacent corners of sheet 100 are joined, sheet 100 can be more easily installed and removed from a mattress.

Figure 7:
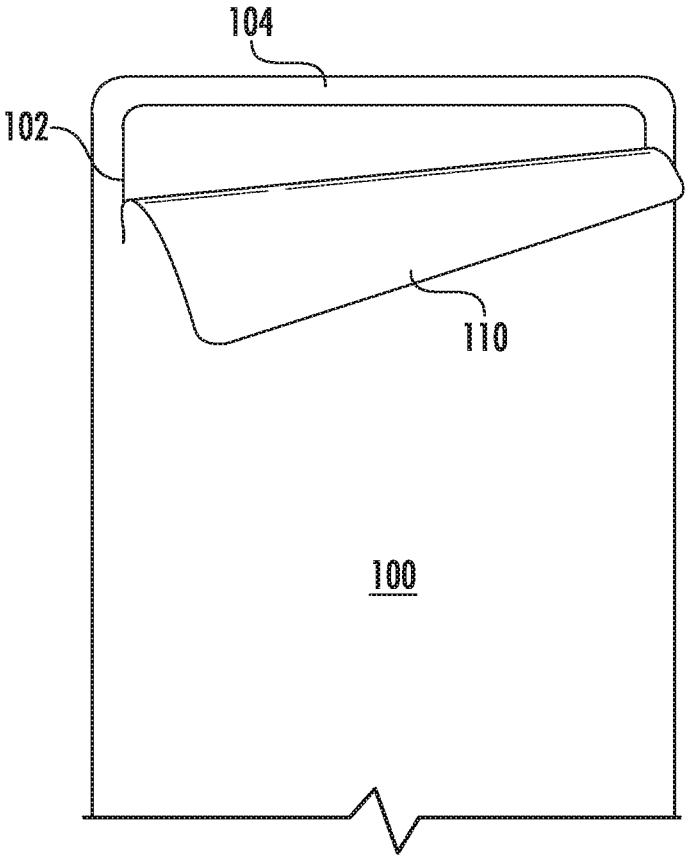
FIG. 7 is a top view of the mattress protector in FIG. 6 illustrating cuts extending laterally across the mattress protector according to an aspect of the subject matter described herein.
Figure 8:
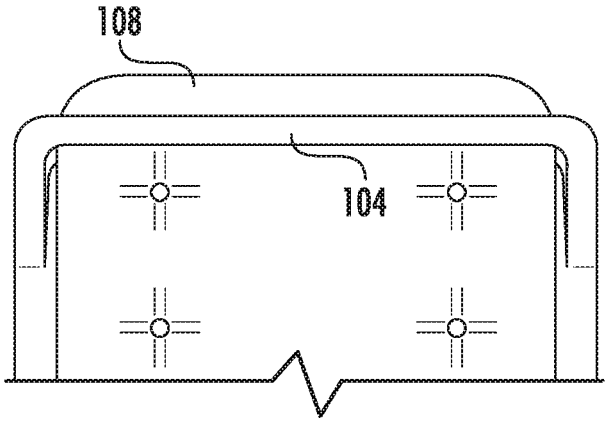
FIG. 8 is a close up view of one corner of the mattress protector of FIG. 6 attached to a mattress.

The result of the cuts illustrated in FIG. 6 is shown in FIG. 7. More particularly, FIG. 7 is a top view of a portion of sheet 100 where an end flap 110 is formed by cut 102. End flap 110 is positionable on a protected surface of a mattress. In FIG. 7, each end of sheet 100 forms a single corner attachment member 104 that extends under both corners of each end of a mattress. In FIG. 8, corner attachment member 104 extends laterally across the underside of mattress 108 to secure sheet 100 to mattress 108.

Figure 9:
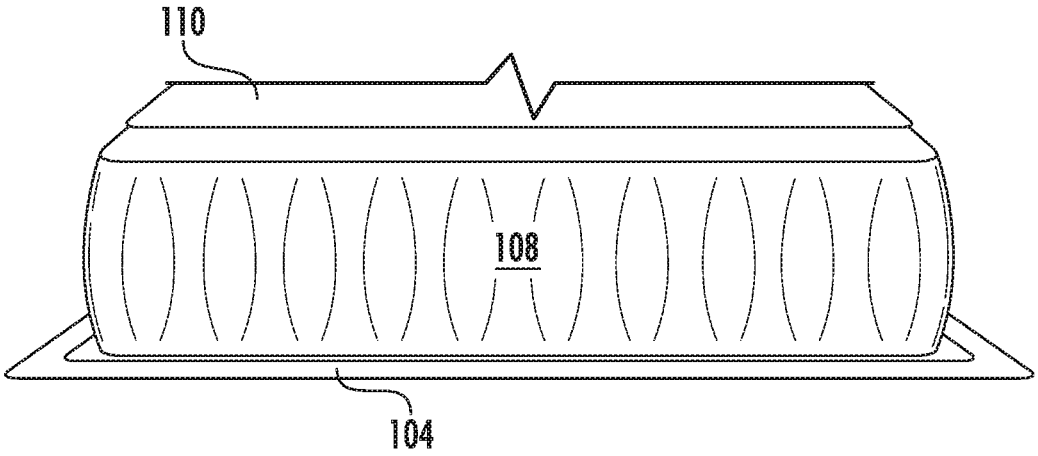
FIG. 9 is an end view illustrating the mattress protector of FIG. 6 attached to a mattress.

FIG. 9 is an end view of sheet 100 attached to mattress 108. In FIG. 9, corner attachment member 104 extends laterally under one end of mattress 108, and flap 110 covers the protected surface of mattress 108.

Figure 10:
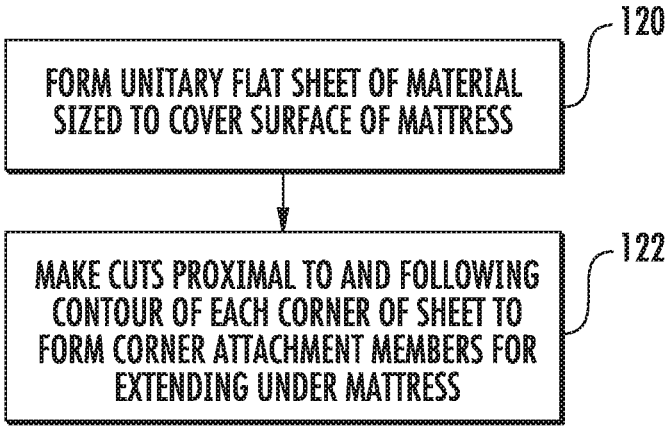
FIG. 10 is a flow chart of a method for manufacturing a mattress protector according to an embodiment of the subject matter described herein.

FIG. 10 is a flow chart illustrating a method for manufacturing a mattress protector as illustrated in FIGS. 1-9. Referring to FIG. 10, in step 120, a unitary flat sheet of material sized to cover a surface of the mattress is formed. Such a sheet may be formed of woven or nonwoven materials. In one example, the sheet is formed using a spin-bonding process. The material used to form the sheet may be liquiphobic or treated to be liquiphobic.

In step 122, cuts are made proximal to and following a contour of each corner of the sheet. In one example, the cuts do not extend from corner to corner. In an alternate example, the cuts extend laterally across the surface of each sheet from corner to corner to form flaps. After step 122 the sheet is a unitary piece of material with cuts that form attachment members to attach the sheet to a mattress and form a mattress protector.

Thus, a mattress protector according to the subject matter described herein can be made inexpensively and is easy to change. By not requiring straps or other sewn-in features for attachment, a mattress protector as described herein is easy to manufacture. Such a mattress protector may be disposable and can be replaced, for example, after each guest leaves a room in a hotel.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A mattress protector comprising: a unitary flat sheet for covering a surface of a mattress and providing a liquiphobic barrier for the surface; and the flat sheet having four corners with cuts in the sheet proximal to and following a contour of each corner to form corner attachment members for extending from the surface and under the mattress, thereby securing the sheet to the mattress, wherein each of the cuts includes a first portion that extends in a direction parallel to an end edge of the unitary flat sheet and a second portion that extends in a direction orthogonal to the first portion and parallel to a lateral edge of the unitary flat sheet, wherein the cuts extend fully laterally from corner to corner along ends of the sheet to form end flaps.

2. The mattress protector of claim 1 wherein the sheet is formed of a nonwoven material.

3. The mattress protector of claim 1 wherein the sheet is formed of a spun-bound material.

4. The mattress protector of claim 1 wherein the sheet includes a liquiphobic coating.

5. The mattress protector of claim 1 wherein the sheet does not include sewn in features for attachment to the mattress.

6. A method for making a mattress protector, the method comprising: forming a unitary flat sheet for covering a surface of a mattress and providing a liquiphobic barrier for the surface; and forming cuts in the sheet proximal and following a contour of each corner to form corner attachment members for extending from the surface and under the mattress for securing the sheet to the mattress, wherein each of the cuts includes a first portion that extends in a direction parallel to an end edge of the unitary flat sheet and a second portion that extends in a direction orthogonal to the first portion and parallel to a lateral edge of the unitary flat sheet, wherein forming the cuts includes forming the cuts to extend fully laterally from corner to corner of the sheet and thereby forming end flaps.

7. The method of claim 6 wherein forming the sheet includes forming the sheet of a nonwoven material.

8. The method of claim 6 wherein forming the sheet includes forming the sheet of a spun-bound material.

9. The method of claim 6 wherein the unitary flat sheet comprises a liquiphobic material or a material that is treated to be liquiphobic.

10. The method of claim 6 wherein forming the sheet includes forming the sheet without sewn-in attachment members.

* * * * *